US008701685B2

(12) United States Patent
Chipman

(10) Patent No.: US 8,701,685 B2
(45) Date of Patent: Apr. 22, 2014

(54) EYELASH EXTENSION TRAYS

(71) Applicant: Zachary Chipman, Orem, UT (US)

(72) Inventor: Zachary Chipman, Orem, UT (US)

(73) Assignee: Zachary Chipman, Orem, UT (US)

( * ) Notice: Subject to any disclaimer, the term of this patent is extended or adjusted under 35 U.S.C. 154(b) by 0 days.

(21) Appl. No.: 13/675,733

(22) Filed: Nov. 13, 2012

(65) Prior Publication Data

US 2013/0133681 A1 May 30, 2013

Related U.S. Application Data

(60) Provisional application No. 61/564,022, filed on Nov. 28, 2011.

(51) Int. Cl.

| | |
|---|---|
| ***A41G 3/00*** | (2006.01) |
| ***A41G 5/00*** | (2006.01) |
| ***A45D 40/30*** | (2006.01) |
| ***A45D 44/00*** | (2006.01) |
| ***B65D 69/00*** | (2006.01) |
| ***B65D 71/00*** | (2006.01) |
| ***B65D 1/34*** | (2006.01) |
| ***B65D 6/04*** | (2006.01) |

(52) U.S. Cl.

USPC ..... 132/201; 132/216; 132/53; 132/333; 206/581; 206/565

(58) Field of Classification Search

USPC ..... 132/216, 200, 201, 212, 213, 217, 73.5, 132/317, 320, 330, 331, 333, 218, 53, 286, 132/294, 73, 314, 54, 55; 206/557–559, 206/562, 563–565, 526, 63.5, 581, 823, 206/575, 813; 211/85.1, 85.18, 126.1, 211/126.12, 70.1; 248/346.03, 118; 269/900; D9/721, 738, 749, 757–760, D9/432, 428, 429, 431; 312/126; 40/124.07; D28/61, 92, 73, 99, 83

See application file for complete search history.

(56) References Cited

U.S. PATENT DOCUMENTS

| | | | | | |
|---|---|---|---|---|---|
| 2,503,552 | A | * | 4/1950 | Hassler | 132/217 |
| 2,593,430 | A | * | 4/1952 | Frankenstein | 206/446 |
| 2,812,768 | A | * | 11/1957 | Giuliano | 132/201 |
| 2,835,259 | A | * | 5/1958 | Goodman | 132/53 |
| 3,200,823 | A | * | 8/1965 | Sebastian | 132/216 |
| 3,315,689 | A | * | 4/1967 | Melik | 132/317 |

(Continued)

OTHER PUBLICATIONS http://www.thelashe.com/Professional_Products_Individual_Eyelash_Extensions_The_Lashe.html.

(Continued)

*Primary Examiner* — Vanitha Elgart

(74) *Attorney, Agent, or Firm* — Jeffrey K. Riddle; Van Cott, Bagley, Cornwall & McCarthy P.C.

(57) ABSTRACT

An eyelash extension system includes an extension strip with a backing and a plurality of eyelash extensions. Each extension has a proximal end and a distal end. The proximal end of each extension is joined to the backing and distal end of each extension extends away from the backing. The system also includes an extension tray with at least one curved extension attachment surface to receive the extension strip such that adhering the extension strip to the curved extension attachment surface spreads the distal ends of the extensions farther apart than the proximal ends of the extensions joined to the backing.

14 Claims, 10 Drawing Sheets

(56) References Cited

U.S. PATENT DOCUMENTS

| | | | | | |
|---|---|---|---|---|---|
| 3,333,593 | A | * | 8/1967 | McGivern | 132/217 |
| 3,416,655 | A | * | 12/1968 | Shiffman | 206/564 |
| 3,447,542 | A | * | 6/1969 | McCullough | 132/53 |
| D215,821 | S | * | 11/1969 | Aylott | D9/721 |
| 3,491,775 | A | * | 1/1970 | Aylott | 132/313 |
| 3,511,248 | A | * | 5/1970 | Panda | 132/216 |
| 3,516,423 | A | * | 6/1970 | Seidler | 132/216 |
| 3,517,673 | A | * | 6/1970 | Charles | 132/214 |
| 3,557,653 | A | * | 1/1971 | Kim | 83/522.19 |
| 3,591,032 | A | * | 7/1971 | Baxter | 217/26.5 |
| 3,644,955 | A | * | 2/1972 | Mackiernan | 15/104.92 |
| 3,645,281 | A | * | 2/1972 | Seidler | 132/333 |
| D223,787 | S | * | 6/1972 | Seidler | D28/73 |
| 3,935,872 | A | * | 2/1976 | Aylott | 132/216 |
| 4,018,336 | A | * | 4/1977 | Aylott | 206/460 |
| 5,147,038 | A | * | 9/1992 | Pergeau | 206/373 |
| 6,029,674 | A | * | 2/2000 | Han | 132/216 |
| 6,516,556 | B1 | * | 2/2003 | Rigler | 43/57.1 |
| 7,222,629 | B1 | * | 5/2007 | Han | 132/216 |
| D559,464 | S | * | 1/2008 | Singh et al. | D28/73 |
| D640,834 | S | * | 6/2011 | Chen | D28/83 |
| D669,223 | S | * | 10/2012 | Lee et al. | D28/73 |
| 8,424,542 | B1 | * | 4/2013 | Han | 132/216 |
| 2008/0289359 | A1 | * | 11/2008 | Godowski et al. | 62/457.6 |

OTHER PUBLICATIONS http://www.youtube.com/watch?v=YL2kBgr3d6M; Uploaded by issywebguru on Jun. 24, 2009.

* cited by examiner

Section A-A

EYELASH EXTENSION TRAYS

RELATED APPLICATIONS

The present application claims priority under 35 U.S.C. §119(e) to U.S. Provisional Patent Application No. 61/564,022 filed on Nov. 28, 2011 entitled "Eyelash Extension Tray". This application is herein incorporated by reference in its entirety.

BACKGROUND

Eyelash extensions are enhancements that are designed to add length, thickness and fullness to natural eyelashes. These extensions can be made of mink fur, synthetic plastics or other materials. The eyelash extensions are adhered to individual natural eyelashes with an adhesive. When a strong adhesive is used, the bond between the extensions and natural lash is designed to last until the natural lash falls out.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Eyelash extensions are enhancements that are designed to add length, thickness and fullness to natural eyelashes. These extensions are applied one at a time by a technician to the natural eyelashes of a patron. This individualized application is done to make the eyelash extensions look as natural as possible. If attached properly, the eyelash extensions will remain on the natural eyelash until the natural eyelash falls off.

To apply an eyelash extension, a technician chooses extensions with the desired length (8 millimeters, 10 millimeters, etc.), color, thickness (diameter), and curl and places them on an accessible surface, grasps an individual eyelash extension with tweezers, dips an end of that eyelash extension into an adhesive, then applies the eyelash extension to a natural eyelash of a patron. While this manual process is highly effective in creating eyelashes of desired visual effect, it is time consuming and involves extended periods of fine motor control. In particular, the process of gripping and orienting each eyelash individually is time consuming for technicians. The disordered state of the eyelashes adds to the difficulty because each eyelash has to be separated from other eyelash extensions using the tweezers, grasped in the appropriate location and oriented correctly.

Figure 1:
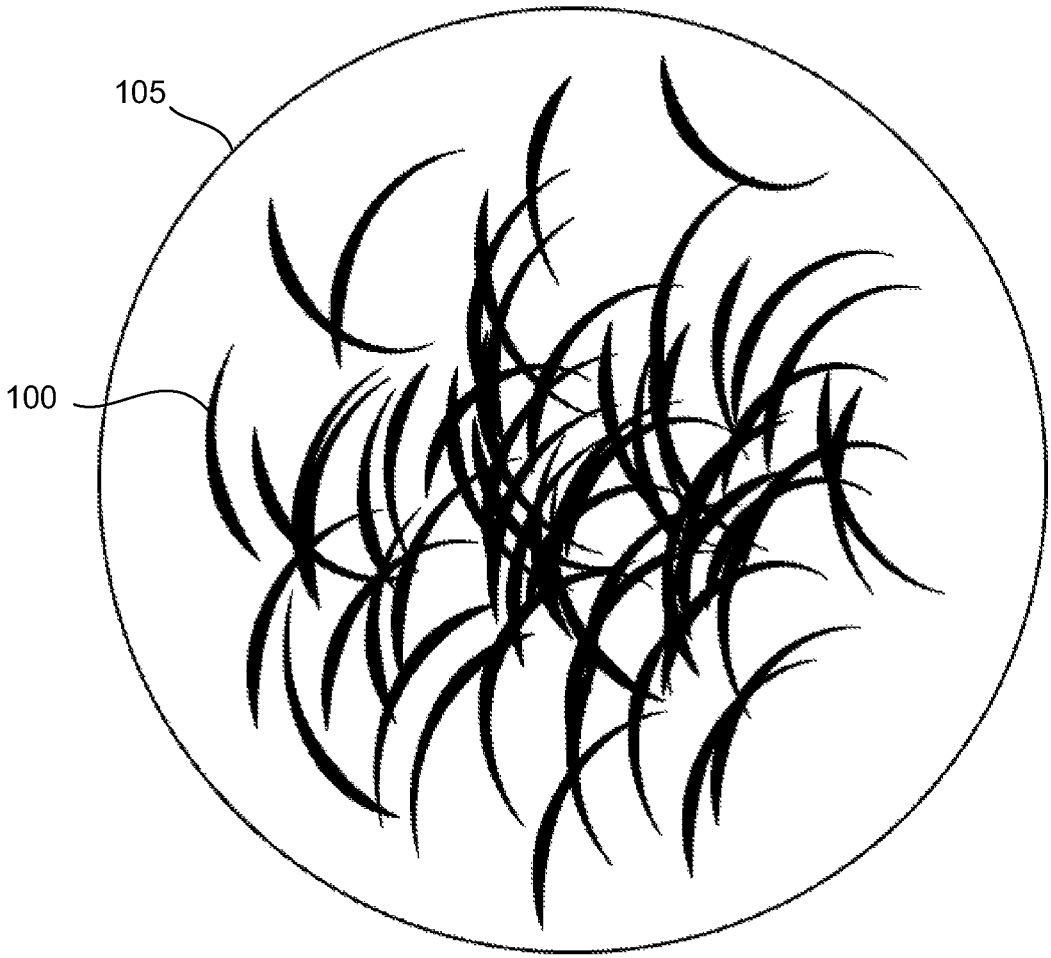
FIG. 1 is an illustration of loose eyelash extensions, according to one example of principles described herein.

FIG. 1 shows eyelash extensions (100) distributed randomly over a surface (105). The eyelash extensions have been loosely packaged and dumped onto the surface (105). When the extensions are mixed and tangled together, a technician is forced to use his or her tweezers to separate, rotate and grasp individual lashes. Because the eyelashes are so small and delicate, the process of separating each individual lash can significantly increase the time it takes to apply the lashes.

Figure 2:
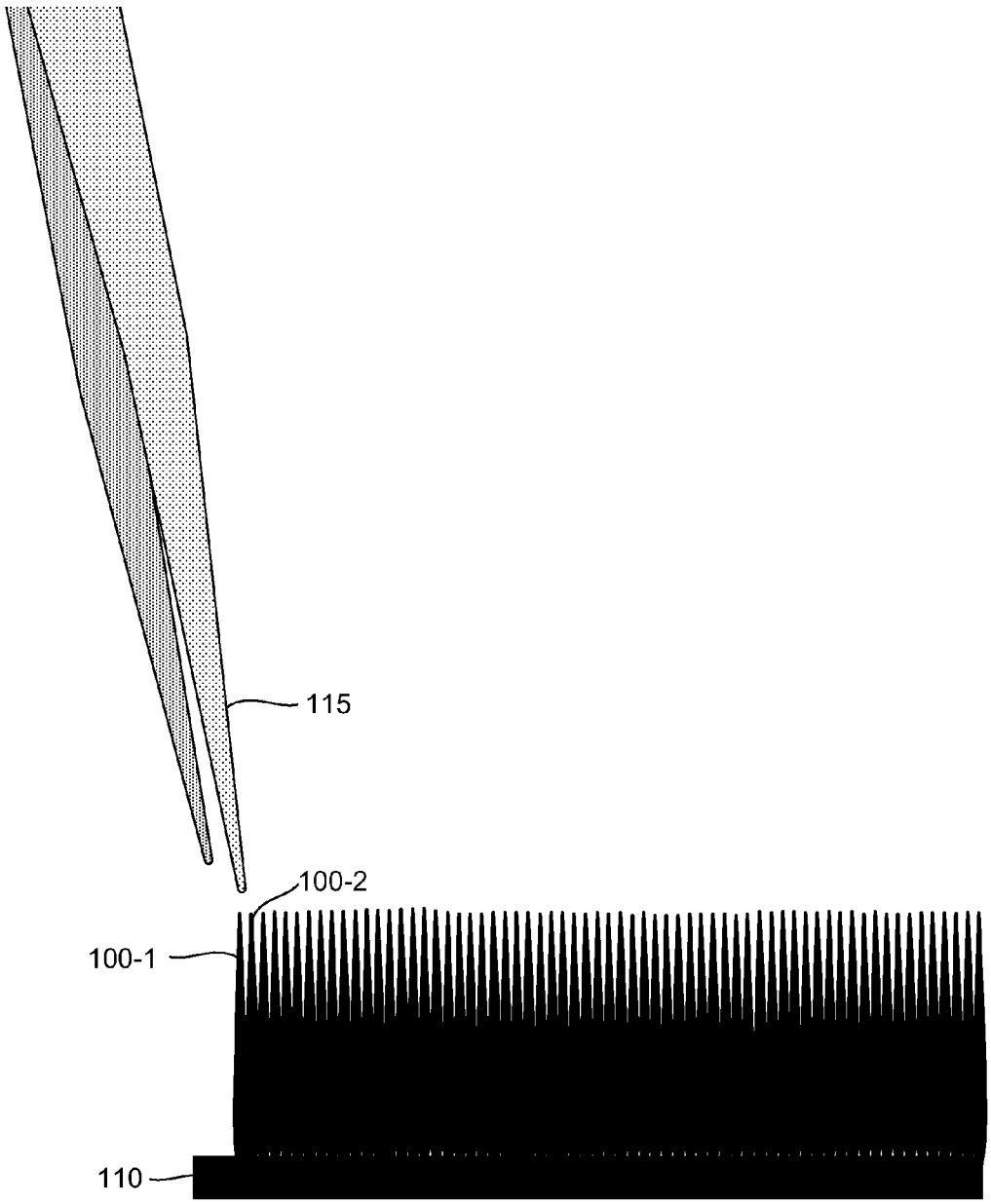
FIG. 2 is an illustration of eyelash extensions on a strip, according to one example of principles described herein.

FIG. 2 shows eyelash extensions (100) with their proximal ends attached to a strip (110). The distal ends of the eyelash extensions are free. This provides some amount of organization and repeatability in the orientation of the eyelashes. However, the distal ends of the extensions are parallel and very close together. Consequently, it can require even more motor control to separate and grasp an individual eyelash extension. For example, the technician may attempt to insert one side of the tweezers (115) between a first extension (100-1) and a second extension (100-2). It may take the technician several attempts to place the tweezers between the two extensions. Once the extensions are separated, the technician can close the tweezers over the desired portion of the extension and pull it from the strip (110). This exacting task is repeated for each extension that is used, with 60 to 120 individual extensions being used for each patron. A technician may spend 1½ to 3 hours per patron and may see multiple patrons per day. The cumulative hand and eye strain that results from repeatedly separating and grasping extension can be significant.

After the technician grasps the individual extension in the tweezers, the technician dips the proximal end of the extension in an adhesive. A variety of adhesives can be used. Various adhesives have different levels of durability, volatility, and colors. The most common color for the adhesive is black, which matches the color of most extensions. A small amount of the adhesive is typically dispensed from a container onto a "stone". The stone is approximately one to two inches in diameter and ⅛ to ½ inch thick. Higher end stones are made from jade while other "stones" are made from synthetic materials. The stone provides a durable surface to hold several drops of the adhesive. The extensions are then dipped into the adhesive. More adhesive can be deposited onto the stone when the adhesive on the stone is used up or dries out. The stone is typically placed on a work surface at a convenient location.

The portion of the extension that is coated with adhesive is then placed in contact with one of the patron's natural lashes. The adhesive bonds the extension onto the natural lash. Some adhesives provide a short amount of working time where the extension can be adjusted and the adhesive smoothed. The process described above is then repeated for each of the 60 to 120 extensions.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

The principles below describe a reusable eyelash extension tray that allows eyelash extension products to be more easily organized and accessed. The eyelash extension tray can greatly aid technicians during the extension attachment process. For purposes of illustration, the eyelash extensions have not been drawn to scale in the figures. In particular, the thickness of the extensions has been enlarged to allow the geometry of the extensions to be clearly illustrated.

Figure 3:
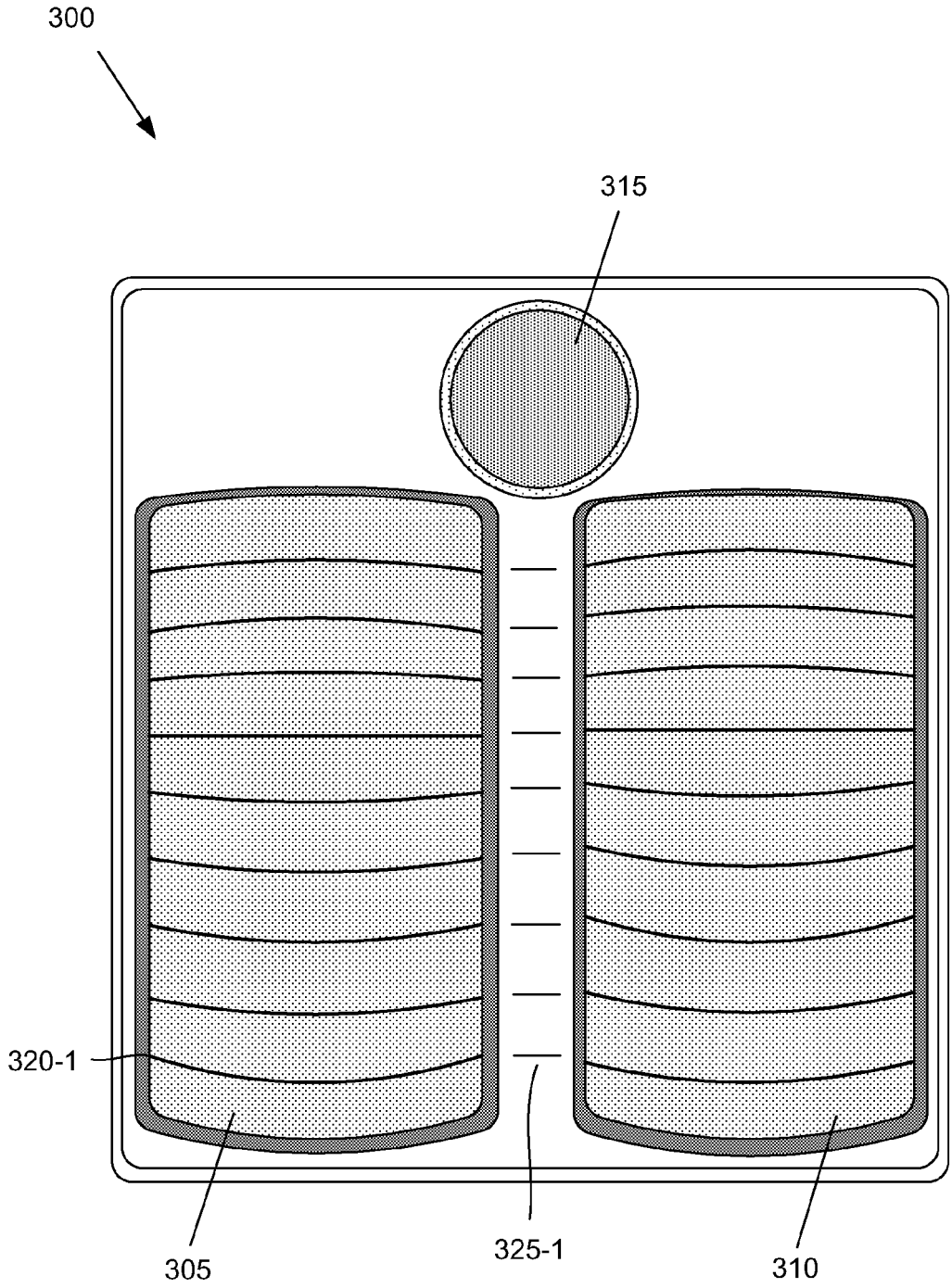
FIG. 3 is a top view of an eyelash tray with two curved surfaces, according to one example of principles described herein.

FIG. 3 is a top view illustration of one example of an eyelash tray (300). In this example, the eyelash tray (300) is rectangular and has two curved surfaces (305, 310) and a recess (315) for an adhesive stone. There are multiple horizontal lines (320-1) marked across the curved surfaces (305, 310) and a series of short, linear markings (325-1) in between the curved surfaces (305, 310). These short, linear markings (325-1) correspond with the horizontal lines (320-1).

Figure 4:
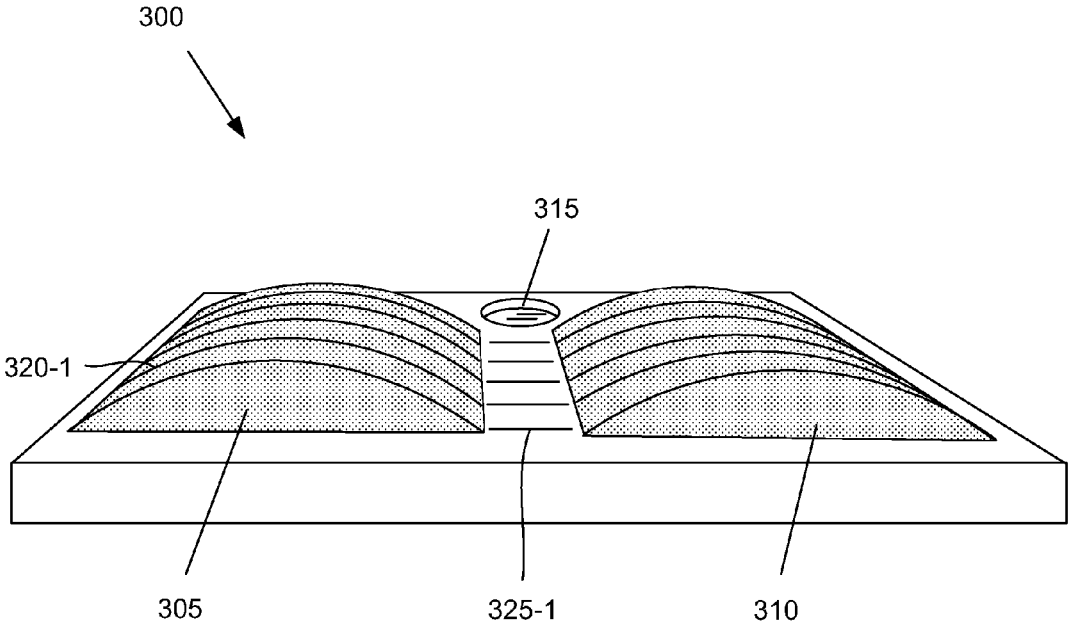
FIG. 4 is an end perspective view of the eyelash tray, according to one example of principles described herein.

FIG. 4 shows an end view perspective of the eyelash tray (300). The arc of the two curved surfaces (305, 310) is clearly visible. The curved surfaces (305, 310) are designed to receive flat strips of eyelashes. The depth of the recess (315) for the adhesive stone is also visible. The linear markings (325-1) in between the two curved surfaces (305, 310) designate areas in which a technician may write what type, color, or size of eyelash extension has been placed on the corresponding horizontal lines (320-1).

Figure 5:
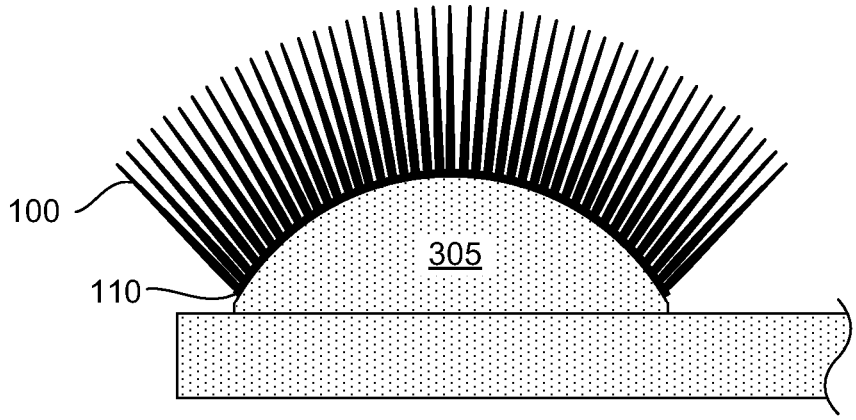
FIG. 5 is a diagram showing a strip of eyelash extensions adhered to a curved surface of an eyelash tray, according to one example of principles described herein.

FIG. 5 is a close-up end view of one of the curved surfaces (305) and demonstrates that when an eyelash extension strip (110) is adhered to the curved surface (305), the arc in the curved surface (305) spreads the distal ends of the eyelash extensions (100) farther apart than the proximal ends that are attached to the eyelash strip.

Figure 6:
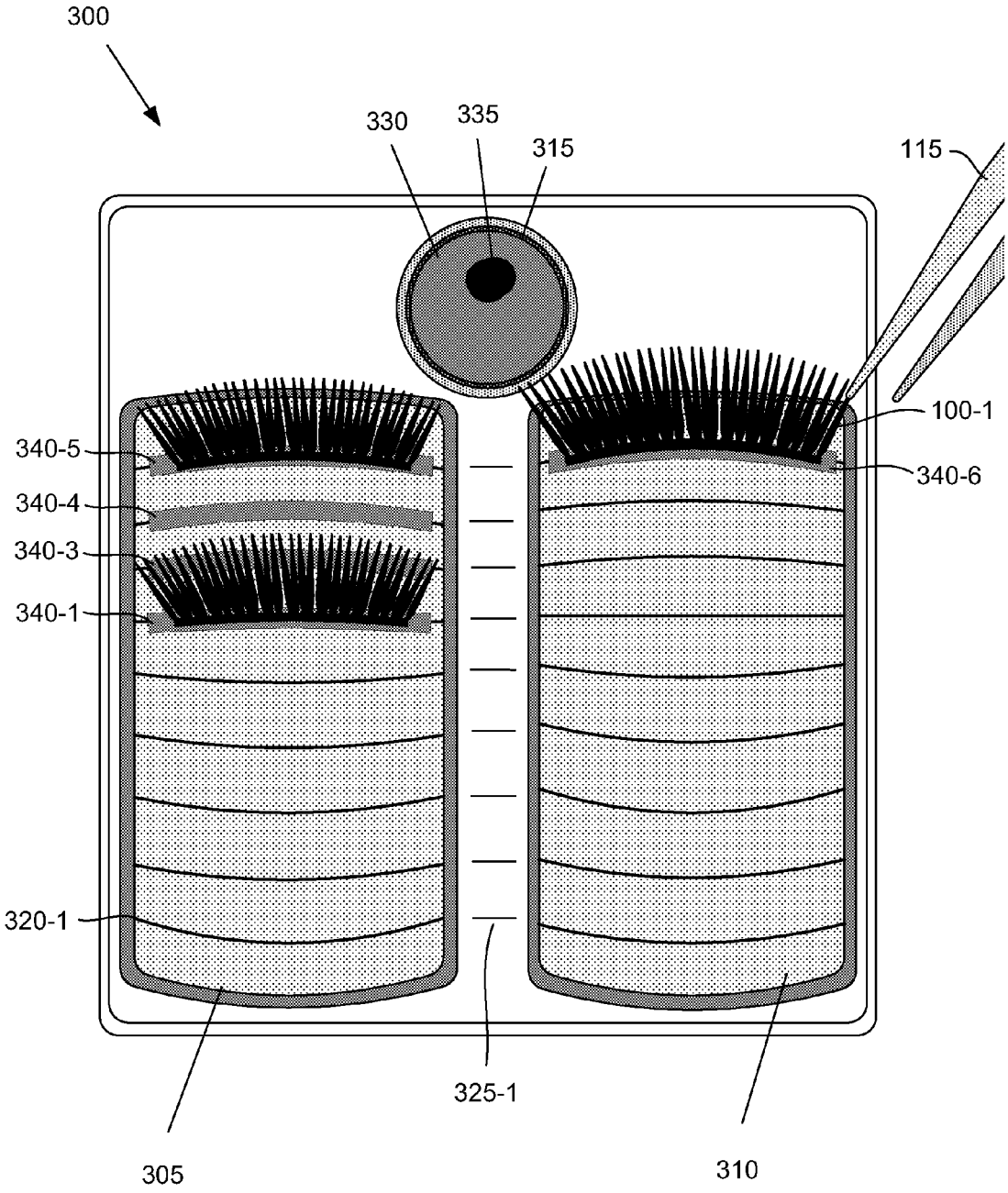
FIG. 6 is a top view of the eyelash tray with various eyelash strips attached to the curved surfaces, according to one example of principles described herein.

FIG. 6 is a top view of the eyelash tray (300) with curved attachment surfaces (305, 310). Attached to the curved surfaces (305, 310) are several extension strips (340-1, 340-3, 340-4, 340-5, 340-6). Hereinafter, these illustrative extension strips are collectively identified as "extension strips 340." The initially flat extension strips (340) are placed on the curved surfaces (305, 310) in areas that are marked by the horizontal lines (320-1). Because of the upward, cylindrical curvature in each of these surfaces (305, 310), when the extension strips (340) are adhered to the curved surfaces (305, 310) the center of the extension strips is elevated above the ends of the extension strips. This causes the distal ends of the extensions to separate from each another, creating a fan-like spread. This spread generates space in between each individual eyelash, making it easier for a technician to localize and grasp an extension (100-1) with a pair of tweezers (115).

The eyelash tray (300) is configured facilitate organization of the various types of eyelash extensions. The extensions can be organized by color, thickness, curl, length or other characteristic. For example, the left curved surface may be used to organize extensions with a thickness of 0.15 mm and lengths between 8 mm and 15 mm. The right curved surface may be used to organize extensions with a thickness of 0.20 mm and lengths between 8 mm and 15 mm. A variety of other organizations could also be used.

FIG. 6 also shows an adhesive stone (330) inserted into the recess (315). As discussed above, a small amount of adhesive (335) is placed on the upper surface of the stone (330). The tray is designed to minimize the distance between the adhesive (335) and extensions (100) and to locate the adhesive to a fixed location relative to the extensions. The stone (330) and adhesive (335) are in close proximity to the extensions on the curved surfaces (305, 310) so that the technician may grip an extension (100-1) with the tweezers (115) and then immediately dip the end of it into the adhesive glue (335).

The fixed spatial relationship created by the tray between the adhesive glue (335) and extensions (100) allows the technician to build up muscle memory over repeated motions to grasp the eyelash extension and to dip the extension in the glue. Muscle memory is a form of procedural memory that consolidates a specific motor task into memory through repetition. When a movement is repeated over time, long term muscle memory is created for that task, eventually allowing it to be performed without conscious thought. By placing the adhesive stone and glue in a fixed location relative to the extensions, the repeated movement between the extension and adhesive glue can produce muscle memory of the motion. In contrast, if the adhesive glue/stone and eyelash extensions were simply placed on a table, their location would vary over time and interfere with muscle memory learning.

The organization and accessibility of the eyelash extensions and adhesive glue produced by the eyelash extension tray can greatly assist technicians during the eyelash attachment process. It significantly reduces the time that technicians spend organizing, selecting, orienting and applying the eyelashes. Additionally, the spreading of the distal ends of the extensions by the extension tray greatly reduces the cumulative hand and eyestrain that results from repeatedly separating and grasping each individual extension. Furthermore, the fixed spatial relationships between the components create an opportunity for muscle memory learning and faster hand motions.

Figure 7:
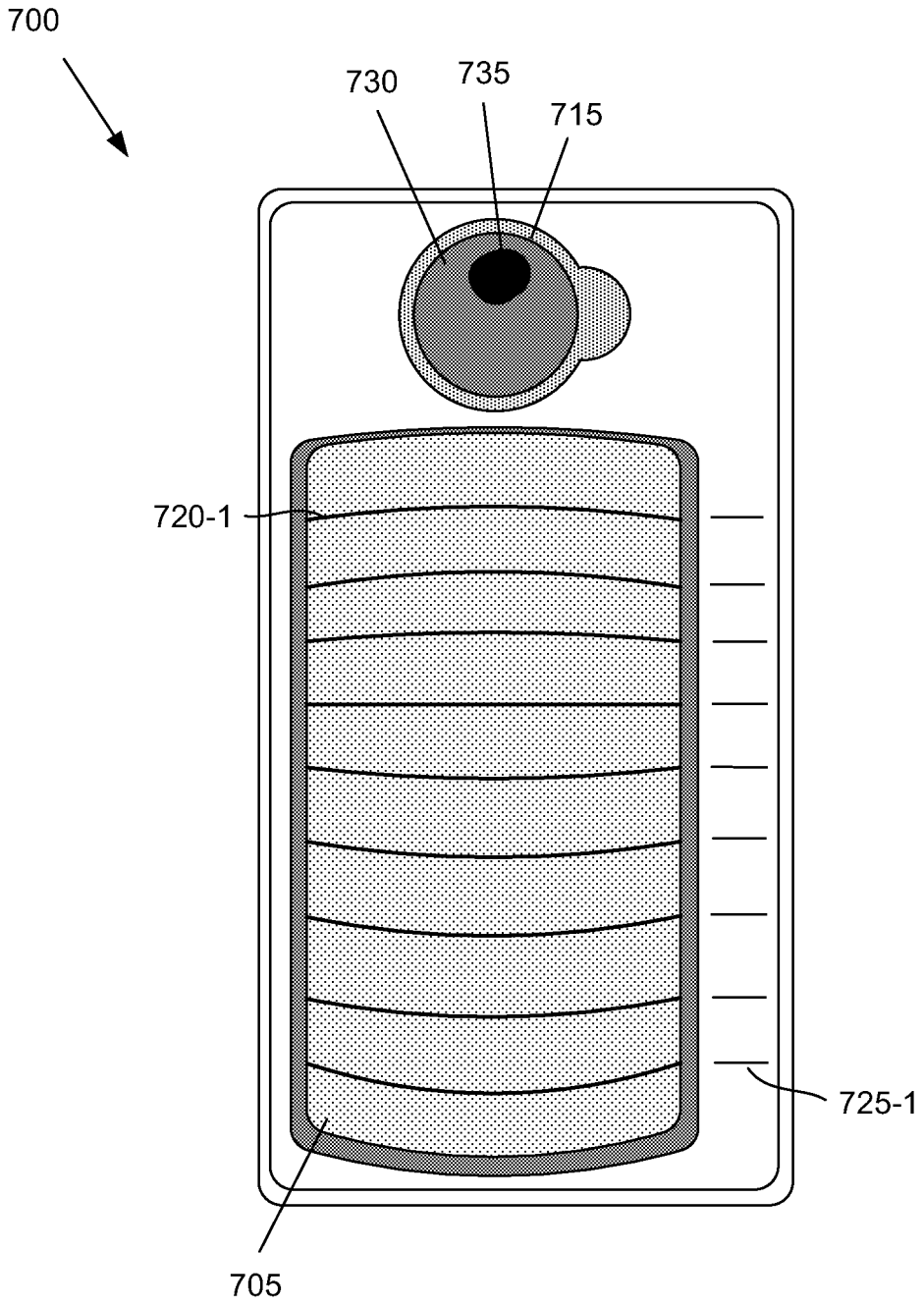
FIG. 7 shows an alternative example of the eyelash tray with one curved surface, according to one example of principles described herein.

FIG. 7 is a top view of an alternative example of an eyelash extension tray (700). This eyelash tray (700) has a narrow, rectangular shape with one curved surface (705) and a recess (715) for an adhesive stone. In this illustration, the recess (715) is occupied by an adhesive stone (730) with adhesive glue (735) on its surface. There are multiple horizontal lines (720-1) that run across the curved surface (705) and a series of short, linear markings (725-1) to the side of the curved surface (705). The horizontal lines (720-1) provide guidance to the technician in adhering the extension strips over the curved surface. The short, linear markings (725-1) correspond with the horizontal lines (720-1) and can be used to indicate which extension strip is adhered to the horizontal lines (720-1). For example, the patron may prefer extensions with a specific curl and/or a specific length. The technician can arrange strips containing these extensions on the horizontal lines and write identifying information to the side. For example, patron may prefer "J" shaped extensions, with shorter extensions on the portion of the eyelid close to the nose and progressively longer lashes toward the outside of the eyelid. The extension tray allows the technician to organize these extensions by adhering the appropriate strips over the horizontal lines and making appropriate notations to the side. For example, the technician may write "J 10" next to extensions that have a "J" curl and a length of 10 millimeters. In some examples, the extension tray may be preprinted with the appropriate extension identifiers.

The functionality of this alternative extension tray (700) has the same advantages as the example discussed above in FIG. 6, but this eyelash tray has a more compact design with only one curved surface (705) instead of two curved surfaces. This extension tray (700) may be preferred by technicians that have fewer eyelash extension strips to place on an eyelash tray and/or for technicians who prefer a narrower eyelash tray that occupies less workspace.

Figure 8A:
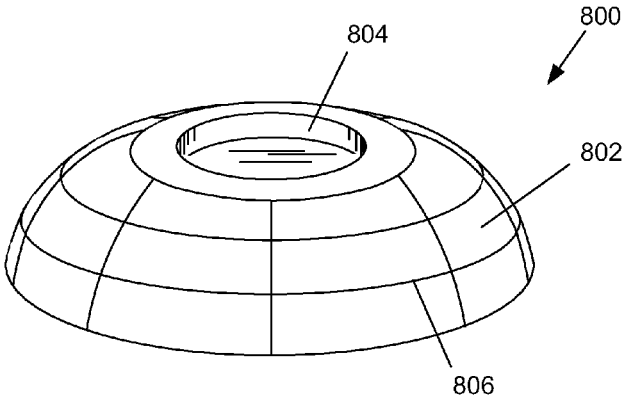
FIGS. 8A-8C show an eyelash extension tray with compound surface curvature, according to one example of principles described herein.

FIG. 8A is an example of an eyelash extension tray (800) that is shaped like a portion of a spheroid. It has a recess (804) for an adhesive stone. The recess (804) for the adhesive stone is at the apex of the spheroid shape. It also has a surface (802) with compound curvature (curvature in both the horizontal and vertical directions). The surface is marked by multiple concentric circles (806) and a divided by vertically curved lines. The compound curvature of the surface (802) provides additional spreading of the distal ends of the eyelash extensions, making it easier for technicians to grasp the distal end of an individual eyelash with a pair of tweezers.

Figure 8B:
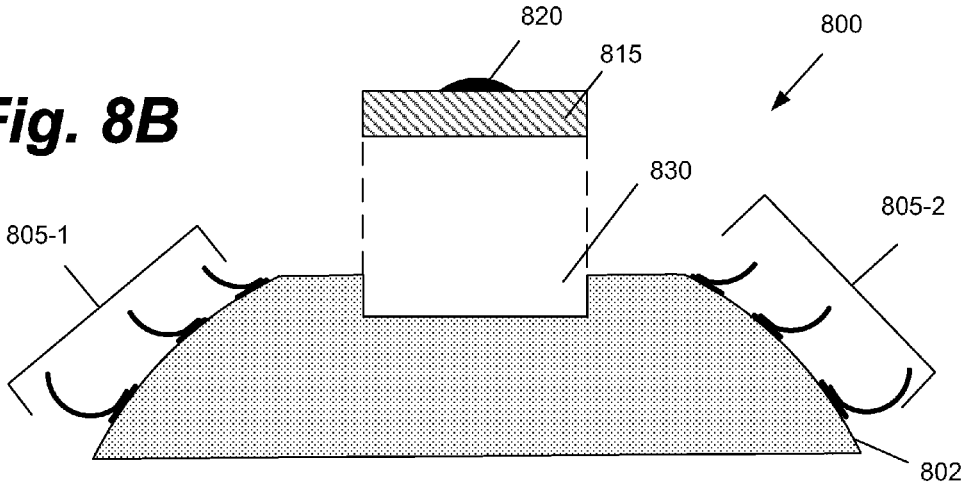

FIG. 8B is a cross sectional diagram of the extension tray (800) shown in FIG. 8A. An adhesive stone (815) with adhesive glue (820) is shown above the recess (830). Dashed lines illustrate that the adhesive stone fits into the recess (830). Attached to the curved surface (802) are several eyelash extension strips (805-1, 805-2). The eyelashes extension strips are placed around the compound surface following the concentric circles (806, FIG. 8A). The strips with the shortest eyelash extensions may be placed on the top, closest to the recess (830) and the longest extensions may be placed closer to the base of the extension tray (800). This provides a number of advantages. First, the technician can easily distinguish between the lengths of the eyelash extensions by their location. Second, the short eyelashes do not extend over the longer eyelashes on the lower concentric circles. This allows the longer eyelashes to be easily viewed. Third, the curvature of the upper concentric circles is tighter than the curvature of the bottom concentric circles. This tends to increase the angle between the short lashes more than the long lashes. This compensates for the shorter length of the lashes and allows the distal ends of the lashes on all the strips to have the desired spacing.

The recess (830) locates the adhesive stone (815) at the apex of the spheroid shape, reducing the distance that a technician needs to move their hand to dip the distal end of the eyelash extension (815) into the adhesive glue (820) on the stone. The fixed location of the adhesive stone (815) allows the technician to use muscle memory in order to recall the location of the adhesive stone and glue. Furthermore, the symmetrical, spherical shape of the extension tray (800) allows for a compact and aesthetically pleasing way for technicians to store their eyelash extensions.

Figure 8C:
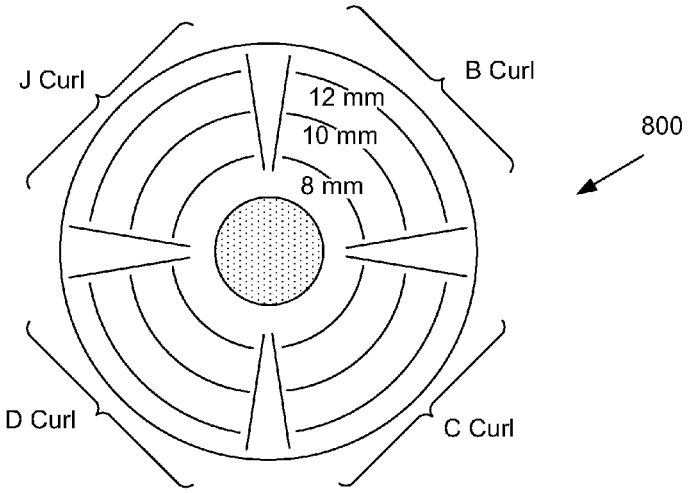

FIG. 8C shows a diagram of one illustrative way to organize extensions on the extension tray (800) with compound curvature. In this example, the extension tray (800) is divided into quadrants, with each quadrant containing a group of extensions that will be used together and have a common characteristic. In each quadrant, extensions with the same curl type are organized with 8 millimeter length extension on the upper small concentric circle, 10 millimeter lashes on the second concentric circle, and 12 millimeter lashes on the lowest and largest concentric circle. The different curls illustrated are the "J curl" which is a more natural curl, the "B curl" which is slightly curlier, the "C curl" for a more glamorous look, and the "D curl" for people that already have very curly lashes.

The extension tray (800) with compound curvature can be rotated to present the desired set of extensions to the technician. The technician can then use exactly the same hand motions to retrieve and place extensions on a patron that desires "J Curl" extensions as a patron that desires "D Curl" extensions.

The implementation shown in FIG. 8C is only one example. The extensions could be arranged in a variety of other ways. For example, all the extensions may have the same curl but different thicknesses (diameters) in each quadrant. The diameter of the extensions may include 0.15 millimeters which is closest to the thickness of natural eyelashes, 0.20 millimeters which provides a mascara effect, and 0.25 millimeters for a more glamorous effect. Additionally, the extensions may be arranged on the concentric circles in ways that are not by length. For example, a technician may use less of one type of extension than another type of extension. The less used extensions could be placed on the upper concentric circle and larger quantities of the more frequently used extensions could be placed around the longer length of the lower concentric circle.

Although the eyelash extension tray is illustrated as being spherically shaped and axially symmetric, it could have a variety of other configurations. For example, the eyelash tray could be ellipsoid, triangular, pyramidal, toroidal, crescent, polygonal, or other desired shape. The strips of extensions could be adapted to fit the particular eyelash tray geometry. For example, the lengths of the strips could be varied. Alternatively, the lengths of the strips could be cut to the desired length by the technician. Different strips or portions of strips could be placed in the same row on the extension tray. In some examples, the strips may be customized by including different types of extensions in a single strip.

Figure 9A:
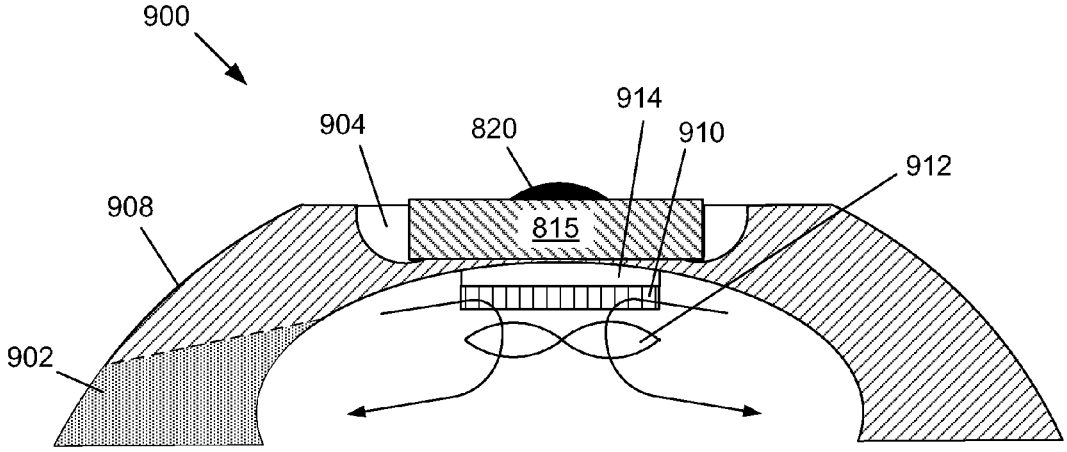
FIGS. 9A-9B are diagrams of an eyelash extension tray with an integrated thermoelectric cooler, according to one example of principles described herein.

FIG. 9A is a cross sectional diagram of the extension tray (900) that cools the adhesive stone (815) to preserve the glue (820). FIG. 9A shows the cross-sectional view of the extension tray along section A-A. The extension tray (900) has a generally spheroid shape with a flat top and flat bottom. The extension tray (900) has a convex, curved surface (908), a recess for an adhesive stone, an adhesive stone (815), and adhesive glue (820). In this example, the extension tray includes a thermoelectric chip (914), heat sink fins (910), and a fan (912). The thermoelectric chip (908) is a solid state electrical device that produces a temperature differential across its thickness when electrical current is applied. The temperature of one of the surfaces of the chip drops and the temperature of the opposite side of the chip increases. This allows the chip (908) to be used as a heater, a cooler, or both. In this example, the thermoelectric chip (908) is used as a cooler. The upper surface of the chip (908) is in close contact with the adhesive stone (815) and cools the stone. This reduces the rate at which volatiles in the glue (820) evaporate and extends the useful lifetime of the glue. This prevents a waste of the specialized glue (820) and helps the technician to create better bonds between the eyelash extensions and the natural eyelash of a patron by preserving the glue's characteristics.

Waste heat produced by the thermoelectric cooler (914) can be removed by attaching a heat sink (910) and a fan (912) to the lower heated side of the chip. The fan (912) moves air over the heat sink (910). The heated air exits through slots (902) in the sides of the extension tray (900).

Figure 9B:
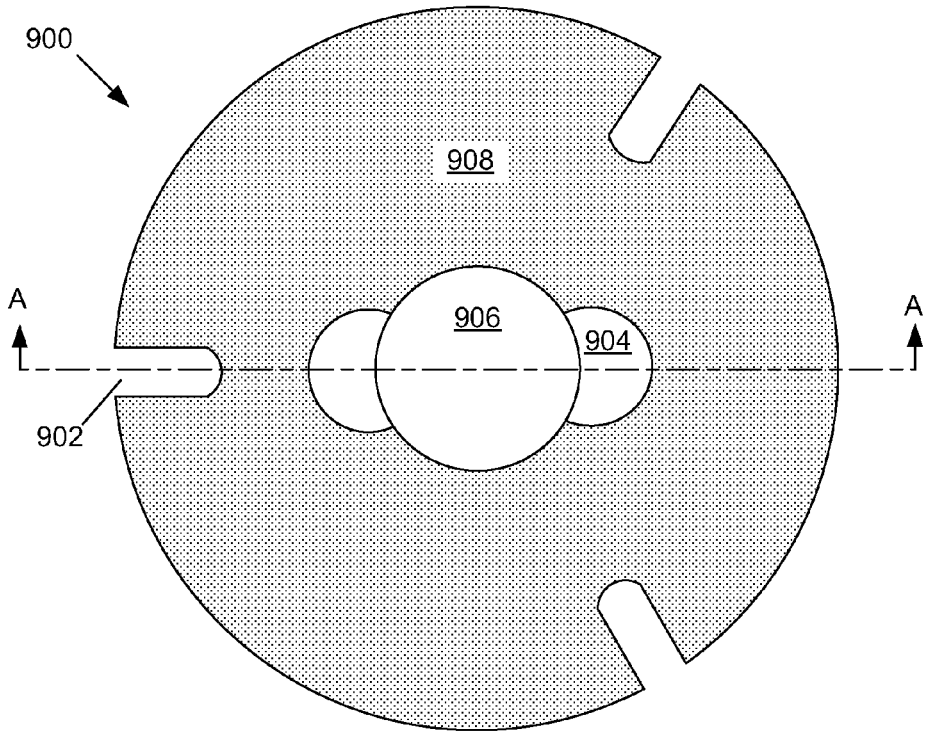

FIG. 9B shows a top view of the eyelash extension tray (900) and illustrates the recess (906) for the adhesive stone, and the curved surface (908) with exhaust slits (902). Cutouts (904) around the recess (906) for the adhesive stone (906) provide access for the technician's fingers to grasp the edges of the stone (815) as it is sitting in the recess. This allows the stone (815) to be more easily removed for cleaning. FIG. 9B shows the location of section line A-A through the extension tray.

Figure 10:
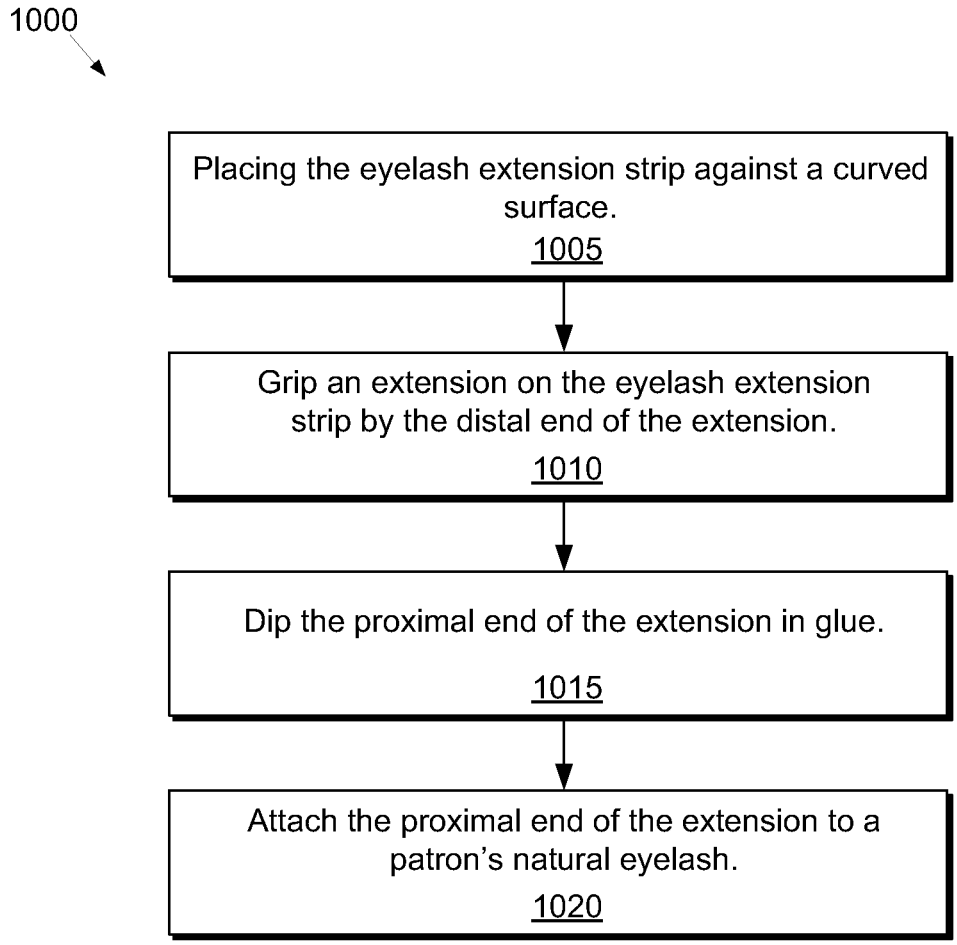
FIG. 10 is a flowchart of a method for using an eyelash extension tray, according to one example of principles described herein.

FIG. 10 is a flowchart (1000) of a method for attaching eyelash extensions. An eyelash extension strip includes backing strip and a plurality of eyelash extensions adhered to the backing strip at their proximal ends with their distal ends extending away from the backing strip. The method includes placing the eyelash extension strip against a curved support surface (step 1005). This spreads the distal ends of the eyelash extensions apart farther than the proximal ends of the eyelash extensions. For example, placing the eyelash extension strip against the curved support surface may be performed by adhering the eyelash extension strip to a convex support surface. The technician then grasps an extension on the extension strip by its distal end (step 1010). Once the technician grips the extension at the distal end, they pull it from the strip and dip the proximal end of the extension in glue (1015). After the end of the extension is dipped in glue, the technician attaches the proximal end of the extension to a patron's natural eyelash (1020).

In sum, placing an eyelash extension strip against a curved surface spreads out the distal ends of the extensions, allowing them to be more easily separated and gripped. An eyelash extension tray with a curved surface and recess for an adhesive stone allows eyelash extension products to be more easily organized and accessed. This organization and ease of access can greatly aid technicians during the eyelash attachment process.

The preceding description has been presented only to illustrate and describe examples of the principles described. This description is not intended to be exhaustive or to limit these principles to any precise form disclosed. Many modifications and variations are possible in light of the above teaching.

What is claimed is:

1. An eyelash extension system comprising:

an extension strip comprising a backing and a plurality of eyelash extensions; each extension comprising a proximal end and a distal end, wherein the proximal end of each extension is detachably joined to the backing and the distal end of each extension extends away from the backing; and an extension tray comprising:

at least one curved horizontal extension attachment surface to receive the extension strip such that adhering the extension strip to the curved extension attachment surface spreads the distal ends of the extensions farther apart than the proximal ends of the extensions joined to the backing such that the distal ends of the extensions extend upward from the curved horizontal extension attachment surface; and a recess in the extension tray for holding an adhesive in a fixed position with respect to the at least one curved horizontal extension attachment surface.

2. The system of claim 1, in which the curved extension attachment surface is upwardly curved such that a center of the extension strip is elevated above the ends of the extension strip.

3. The system of claim 1, further comprising markings on the curved extension attachment surface designating locations along which extension strips are to be adhered.

4. The system of claim 1, in which the curved extension attachment surface curves in one dimension.

5. The system of claim 1, in which the curved extension attachment surface is cylindrical.

6. The system of claim 1, in which the curved extension attachment surface comprises a portion of a right circular cylinder.

7. The system of claim 1, in which the curved extension attachment surface comprises two separate upwardly curved surfaces.

8. The system of claim 1, further comprising markings on the extension tray designating lengths of lashes to be attached to the curved extension attachment surface.

9. The system of claim 1, in which the recess in the extension tray comprises a recess for holding an adhesive stone.

10. The system of claim 9, further comprising a thermoelectric cooler to cool the adhesive stone and glue deposited on the adhesive stone.

11. An eyelash extension tray comprising:

two parallel curved horizontal extension attachment surfaces to receive eyelash extension strips;

wherein the eyelash extension strips each comprise a backing and a plurality of eyelash extensions, each eyelash extension comprising a proximal end and a distal end, wherein the proximal end of each extension is detachably joined to the backing and the distal end of each extension extends away from the backing;

such that adhering the extension strips to the attachment surfaces spreads the distal ends of the extensions farther apart than the proximal ends of the extensions joined to the backing;

markings across the curved extension attachment surfaces designating where the extension strips are to be adhered;

markings between the curved extension attachment surfaces identifying the type of eyelash extensions to be placed on the curved extension attachment surface; and a recess in the extension tray for holding an adhesive stone in a fixed position with respect to the curved horizontal extension attachment surfaces.

12. The extension tray of claim 11, in which the curved extension attachment surface is upwardly curved such that a center of the extension strip is elevated above the ends of the extension strip.

13. The extension tray of claim 11, in which the curved extension attachment surface comprises a section of a horizontal right circular cylinder.

14. A method for attaching eyelash extensions, the method comprising:

placing an eyelash extension strip against a curved support surface of an eyelash extension tray;

wherein the eyelash extension strip comprises a backing strip and a plurality of eyelash extensions each comprising a proximal end detachably adhered to the backing strip and a distal end extending away from the backing strip; and wherein placing the eyelash extension strip on the curved support surface spreads the distal ends of eyelash extensions apart farther than the proximal ends of the eyelash extensions such that individual eyelash extensions can be separately gripped and removed from the backing strip;

gripping a distal end of an individual eyelash extension on the eyelash extension strip;

pulling the individual eyelash extension from the backing strip;

moving the individual eyelash extension over an adhesive stone recessed in the eyelash extension tray;

dipping the proximal end of the individual eyelash extension in adhesive on the adhesive stone; and attaching the proximal end of the individual eyelash extension to a patron's natural eyelash.

* * * * *